United States Patent [19]

Thim

[11] Patent Number: 4,522,367

[45] Date of Patent: Jun. 11, 1985

[54] MATRIX ARRAY FOR MANUFACTURING CONCRETE SLEEPER BLOCKS

[75] Inventor: Stig Thim, Växjö , Sweden

[73] Assignees: A-Betong AB; Sabema Material AB, both of Växjö , Sweden

[21] Appl. No.: 649,861

[22] Filed: Sep. 12, 1984

Related U.S. Application Data

[62] Division of Ser. No. 475,661, Mar. 15, 1983, Pat. No. 4,495,127.

[30] Foreign Application Priority Data

Jul. 9, 1982 [IT] Italy ..... 22322 A/82

[51] Int. Cl.[3] ..... B28B 23/06

[52] U.S. Cl. ..... 249/86; 249/94; 264/157; 264/228; 264/297.9; 425/111; 425/123

[58] Field of Search ..... 425/111, 218, 219, 123; 249/86, 93, 94; 264/228, 157, 297.9

[56] References Cited

U.S. PATENT DOCUMENTS

| | | | |
|---|---|---|---|
| 4,038,355 | 7/1977 | Bratchell | 249/86 |
| 4,102,957 | 7/1978 | Da Re | 249/86 |
| 4,242,071 | 12/1980 | Stinton | 425/111 |
| 4,255,104 | 3/1981 | Stinton | 264/228 |
| 4,290,991 | 9/1981 | Thim | 425/111 |

*Primary Examiner*—Willard E. Hoag
*Assistant Examiner*—James C. Housel
*Attorney, Agent, or Firm*—Sughrue, Mion, Zinn, Macpeak and Seas

[57] ABSTRACT

A method of manufacturing railway switch-point concrete sleeper blocks of varying lengths and having different number of attachment means located in mutually different positions for the attachment of rails. A plurality of steel matrix plates 102 whose respective lengths correspond to the desired lengths of the various sleeper blocks and which exhibit detachably mounted dowels 109 are placed end to end in an elongate mould bed with the dowels facing upwardly, whereafter reinforcing lines rods 5 are tensioned and concrete is poured into the mould bed and permitted to harden. The thus formed coherent concrete body is then removed from the mould and the matrix plates removed with the dowels remaining cast in the concrete block. The concrete body is then cut into sleeper blocks of desired length. The dowels are accurately mounted in predetermined positions in frame members affixed to the matrix plates. Upon casting and hardening of the sleeper blocks the frame members are disengaged from the plates and the in-cast dowels for renewed use in a subsequent casting operation.

3 Claims, 10 Drawing Figures

1
1A
1B
2
2a
2b
3
4
4a
5
6
7
8
9
10
11
12

109
109b
109c
116
116
102a
102
109a
113
114
114
114
111
113
111a
112b
112
112a
101
110
101A

MATRIX ARRAY FOR MANUFACTURING CONCRETE SLEEPER BLOCKS

This is a division of application Ser. No. 475,661, filed Mar. 15, 1983, now U.S. Pat. No. 4,495,127.

The present invention relates to a method of manufacturing concrete sleeper blocks having varying lengths and being intended for railway switch-points, said sleeper blocks being provided with means for attaching rails thereto, the number of said attachment means and their respective locations on said blocks varying from block to block.

Methods by which the manufacture of concrete sleepers for railway lines can be automatized to a relatively high degree have previously been proposed in the art. This automatization of the manufacture of concrete sleepers for railway lines has been made possible by the fact that all the sleepers are of substantially the same size and shape, and by the fact that the means for attaching the rails to the sleepers have been located in mutually the same positions on the respective sleepers.

An attempt to automatize the manufacture of concrete sleeper blocks for railway switch-points immediately leads to a multiplicity of difficultly resolved problems. One of the main problems in this respect is that even the most simple type of switch-point requires a large number of sleeper blocks, each of which is different in some respects from another. For example a certain type of switch-point requires 61 sleeper blocks, of which not less than 58 differ from remaining sleeper blocks in one or more respects. Thus, there are differences with respect to the length of the blocks, these differences varying between about 1.5 and about 5 meters or more; differences with respect to the position and the number of attachment means required for mounting the rails on said blocks; differences in the provision and position of grooves and channels in respective blocks for accommodating electrical conductors; and the provision on certain blocks of means for mounting operating means for the movable parts of the switching-point; etc.

Another difficulty with respect to the automatization of the manufacture of concrete sleeper blocks for railway switch-points is that the pre-stressed concrete which must be used in order for the block to obtain the required mechanical strength contracts whilst hardening and detensioning, said contraction varying with different sleeper blocks as a result of their differences in length. It will be understood in this respect that it is of the utmost importance that all bolt holes obtain their correct final position in respective sleepers. Thus, one single faulty sleeper can jeopardize the laying of a complete switch-point, which would naturally incur particularly high costs, not least as the result of the complicated and expensive machinery required for the laying operation.

Another complicated factor in the present context is that the attachment means may obtain different positions in left-handed and right-handed switch-points.

Because of the aforementioned circumstances wooden sleepers have often been used for switch-points, even though concrete sleepers have been used for the remainder of the track. It will be readily understood that such a discontinuity is highly unsatisfactory and that consequently a successful solution to the problem of manufacturing concrete sleepers for railway switch-points would afford a large number of advantages.

In U.S. Pat. No. 4,290,991 there is described a method of manufacturing concrete sleeper blocks for railway switch-points on a factory scale and in a rational manner which enables the necessary individual variations between different sleeper blocks to be obtained with great accuracy and precision.

In this method a plurality of thin matrices whose length corresponds to the length of the various sleeper blocks and which exhibit removably mounted attachment means are placed end to end in an elongate mould with the attachment means extending upwardly, reinforcing rods are tensioned in the mould, concrete is cast in the mould and permitted to harden, the cured coherent concrete body is removed from the mould and the matrices removed from the concrete body and the attachment means cast therein, whereupon the concrete body is cut into lengths corresponding to the desired sleeper blocks.

A basic feature of this known method is that there is used a plurality of matrices of precise dimensions and that the attachment means can be mounted in rather exact positions while taking into account the shrinkage experienced by the concrete block during curing and release of prestress.

The placing of the matrices in an elongate mould enables casting to be carried out in a feasible and efficient manner with the simultaneous casting of a plurality of coherent sleeper blocks in the form of a concrete body having, for example, a length of 30 meters or more. Thus, during the de-moulding operation and the subsequent handling and transport of the sleeper blocks to the cutting station, all the sleeper blocks can be handled as a single unit in the form of said concrete body, which is thus of considerable length.

It will be understood that the said method affords a large number of advantages, for example with regard to the tensioning of reinforcing rods and the actual casting operation, and is superior to a method in which the sleeper blocks are cast individually in separate moulds.

A further possibility to the rationalization of the manufacture of such blocks is afforded by the fact that the mould bed may comprise two or more mutually adjacent parallel mould cavities for moulding substantially simultaneously a corresponding number of elongate concrete bodies. Thus, in this respect the same rod-tensioning carriage can be used for placing the reinforcing ropes in all the mould cavities. Further, abutment plates common for all reinforcing rods and associated spacer plates can be used both with the active abutments of the mould and its passive abutments. There can also be used a common winch for tensioning and drawing the reinforcing rods, and a common tensioning means for the abutment plate at the active abutment.

In addition, the casting of a plurality of sleeper blocks in a mould to form a single coherent concrete body affords the advantage whereby a satisfactory sleeper block with regard to quality and appearance is obtained in conjunction with the casting operation, thereby reducing subsequent treatment to a minimum. The concrete block can be cut precisely and rapidly into desired lengths by means of a diamond saw, so that the cut surfaces of the block obtain a high surface finish. The material lost when cutting the block is, to all practical purposes, of no significance.

Preferably, in practice the concrete body is lifted out of the mould bed and turned before removing the matrices.

Removal of the block from the mould can be effected, for example, by means of an overhead crane, care being taken when lifting the hardened concrete body from the mould. Removal of said block from the mould, however, can be effected in any other suitable manner. Thus, for example, it is possible to use a vertically movable mould bed which, for example, is lowered when removing said body from the mould, whereafter the coherent concrete body is transported away in a suitable manner, conveniently after first having been turned to facilitate removal of the matrices. It is, of course, also possible to remove the matrices without first turning the concrete body.

In order to facilitate cutting of the block, a transverse strip, e.g. a plastics strip, is conveniently placed between consecutive matrices in the mould bed, said strips providing an indication as to where the block shall be cut.

Preferably an edge reinforcement and cleave reinforcement in the form of a wire is wound around the reinforcing rods at the ends of the various matrices prior to the casting operation. The mechanical strength properties of the finished sleeper blocks are improved in this way. In addition, attachment means, e.g. in the form of pairs of encircling stirrup-like structures, are mounted in the mould in order to avoid damage during attaching the base plates.

Individual variations in the various sleeper blocks can be provided by introducing into the mould bed prior to the cutting operation different types of so-called "dummies" intended to form in the finished sleeper blocks suitable recesses, e.g. through which electrical conductors can be drawn. The matrices can thus conveniently be provided with suitable markings indicating the suitable position for such dummies.

When using this type of matrices, the important advantage is afforded whereby the same matrices can be used for manufacturing sleeper blocks both for left-hand and right-hand railway switching-points, said matrices being turned and the attachment means applied to one side of the matrix when manufacturing sleeper blocks for right-hand points, and on the other side when manufacturing sleeper blocks for left-hand points.

To make this possible, the matrices are preferably provided with through-passing holes which are used when mounting the attachment means in one or the other of said directions. The sleeper blocks thus produced will be mirror images of each other.

To facilitate both the actual manufacturing process and the final handling of the finished sleeper blocks, it is preferred that the two sides of the matrices are provided with such markings (mirror-turned) that it can be seen on the upper surface of the finished sleeper blocks, thereby to indicate the type of switch-point concerned and the sequence number of a block in the sleeper blocks belonging to a switch-point. To this end all matrices are provided on both sides with a marking plate, providing in the finished sleeper block a clearly visible and understandable simple and reliable code system.

One object of the present invention is to further improve the method disclosed in the said Swedish Patent and described above in the first place by mounting the removable attachment means more accurately relative to the matrices and, further, by making it possible to use matrices of less thickness.

The invention also relates to a matrix array for the manufacture of concrete sleeper blocks for railway switch-points, said matrix array suitably comprising planar plates made of steel and suitably having a thickness of less than 5 mm, preferably about 2–3 mm.

The holes in the matrices are preferably through-passing holes, thereby to enable the attachment means and the frame members to be readily mounted on one side for the manufacture of sleeper blocks for left-hand switch-points, and on the other side for the manufacture of sleeper blocks for right-hand switch-points.

The invention will now be described more in detail with reference to the accompanying, partly schematic drawings, in which FIGS. 1–7 refer to the known method disclosed in the abovementioned Swedish Patent, whereas FIGS. 8–10 illustrate the improvement according to the present invention.

Referring firstly to the known method illustrated in FIGS. 1–7, FIG. 1 shows a mould bed 1 having two parallel adjacent mould cavities 1A and 1B intended for casting two coherent concrete bodies, which are subsequently to be cut into sleeper blocks for a railway switching-point.

The mould bed suitably has a length of, for example, 32 m and assuming that the average length of the finished sleeper blocks is from 2 to 3 meters, about 10 to 16 sleeper blocks can be simultaneously cast in each of the mould cavities.

If it is also assumed that a complete switch-point includes at least 60 sleeper blocks—of which the majority exhibit mutually different variations with respect to length and/or the position of and number of attachment means—it will be seen that in order to manufacture all the sleeper blocks required for such a switch-point in a mould having two mould cavities of the aforementioned type, at least two complete casting cycles are required with associated preparation of the mould, hardening of the cast concrete and subsequent de-moulding.

Figures 1, 2:
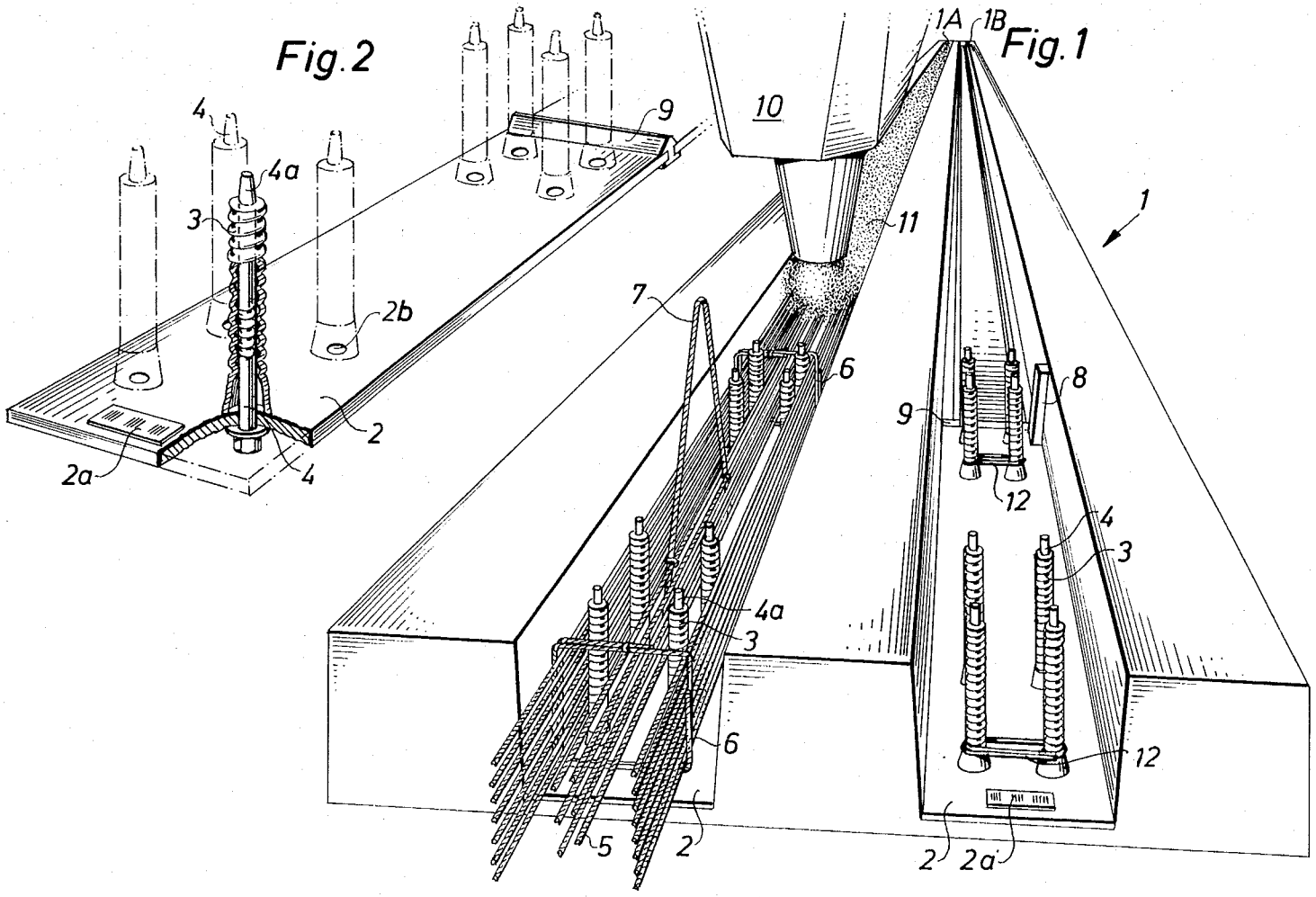
FIG. 1 is a perspective view of a mould having two mutually adjacent parallel mould cavities for manufacturing concrete sleeper blocks for railway switch-points.
FIG. 2 is a perspective view illustrating a matrix with attachment means mounted thereon, said attachment means having the form of so-called dowels on the side of a matrix of similar type to that inserted in the mould cavity illustrated in FIG. 1.

The two mould cavities 1A and 1B illustrated in FIG. 1 are intended for upward and downward sleeper manufacture and accommodate a plurality of mutually adjacent relatively thin steel matrices or matrix plates which are introduced into the bottom of respective cavities and which are provided with upwardly extending attachment means in the form of screw-threaded dowels. The general form of the matrices 2 and the dowels 3 can be seen from FIG. 2. Each of the matrices has on one end thereof a marking plate 2*a* with a mirror-image marking which indicates the kind of switch-point in question and the sequence number for the concrete sleeper to be cast while using the matrix.

In the left mould cavity 1A shown in FIG. 1 there has been introduced a plurality of reinforcing rods 5 and arranged in the region of the ends of respective matrices is a wire 6 which embraces the reinforcing rods and which is intended to form an edge and cleavage reinforcement in the finished sleeper blocks.

Shown in the mould cavity 1A is a lifting eye 7 for the finished concrete body, and in mould cavity 1B a stirrup 12 which is passed around two adjacent dowels. The lifting eye 7 is mounted at one of the reinforcing rods 5. Arranged between adjacent matrices 2 is a strip 9, which may be made of a plastics material, which indicates where the block shall be cut.

Arranged in the right mould cavity 1B in FIG. 1 is a dummy 8 intended to form a corresponding cavity in the finished sleeper block, e.g. a cavity which facilitates the arrangement of electrical conductors in said block.

FIG. 1 also illustrates part of a casting machine 10 arranged to pour concrete 11 into the mould cavity 1A.

Figure 3:
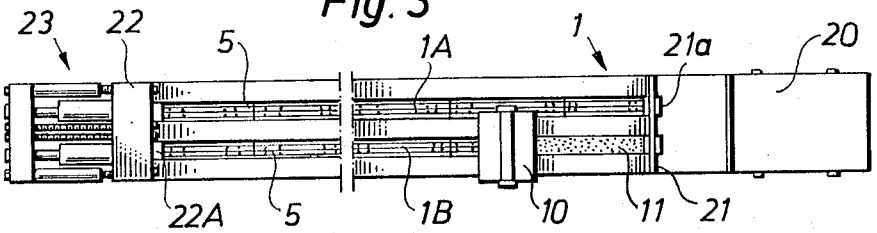
FIG. 3 is a plan view of a mould according to FIG. 1, with both mould cavities prepared for casting, with concrete being cast in one of said cavities.

FIG. 3 is a plan view illustrating further elements associated with a mould arrangement of the kind illustrated in FIG. 1. In the view shown in FIG. 3, reinforcing rods 5 have been tensioned in both mould cavities 1A and 1B, and the casting machine 10 is laying a stream of concrete in the cavity 1B.

The reinforcing rods are drawn from a carrier (not shown) by means of a carriage 20 movable on rails along the side edges of the mould, with the aid of a winch (not shown) located to the left of the mould arrangement shown in FIG. 3. Subsequent to drawing the reinforcing rods, the ends of the rods are connected to abutment plates 21*a* and 22*a* in the region of the passive and active abutments 21 and 22, respectively, of the mould. A tensioning means 23 including a plurality of hydraulic cylinders co-operates with the active abutment 22. The arrangement is such that all reinforcing rods in the two mould cavities are tensioned simultaneously prior to the commencement of a casting operation and are also releaved simultaneously subsequent to the concrete hardening.

The mould equipment also includes a work table (not shown) for mounting the dowels 3 in the matrices 1. Mounting of the dowels is effected with the aid of special, partially screw-threaded bolts 4 which are passed through holes 2*b* arranged in the matrices, in positions which have been carefully calculated. The length of the bolts 4 is greater than that of the dowels 3 and the ends 4*a* (FIG. 2) of the bolts extending from the dowels are of conical configuration and lack screw-threads. The total length of the bolts is such that through-passing holes are formed in the finished sleeper blocks.

Figure 4:
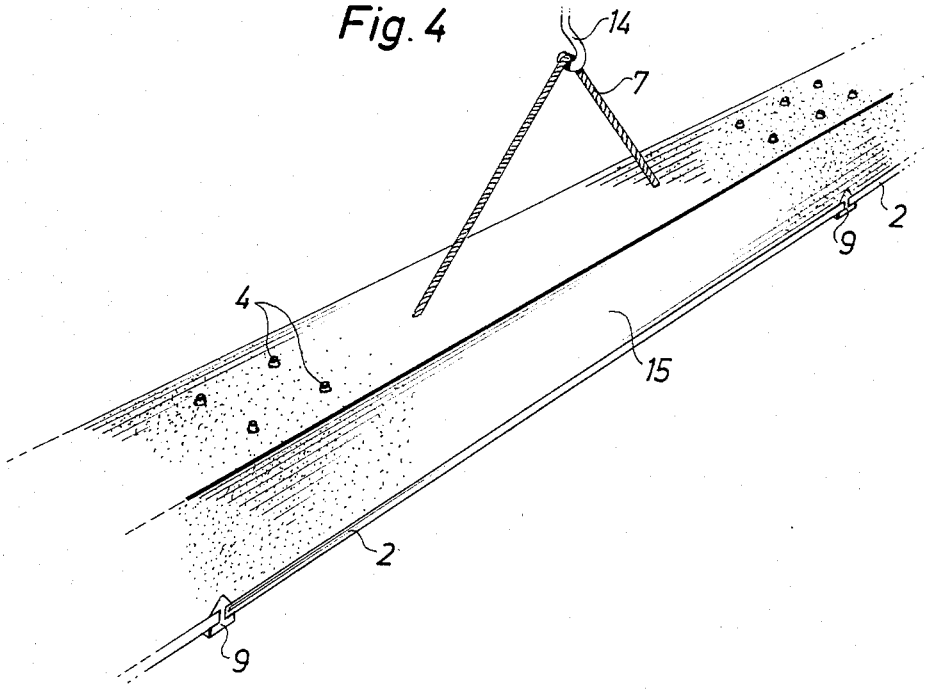
FIG. 4 is a perspective view of a part of coherent concrete body cast in a mould according to FIGS. 1 and 3, said body being shown subsequent to removing it from said mould and during its transportation to a receiving station.
Figure 5:
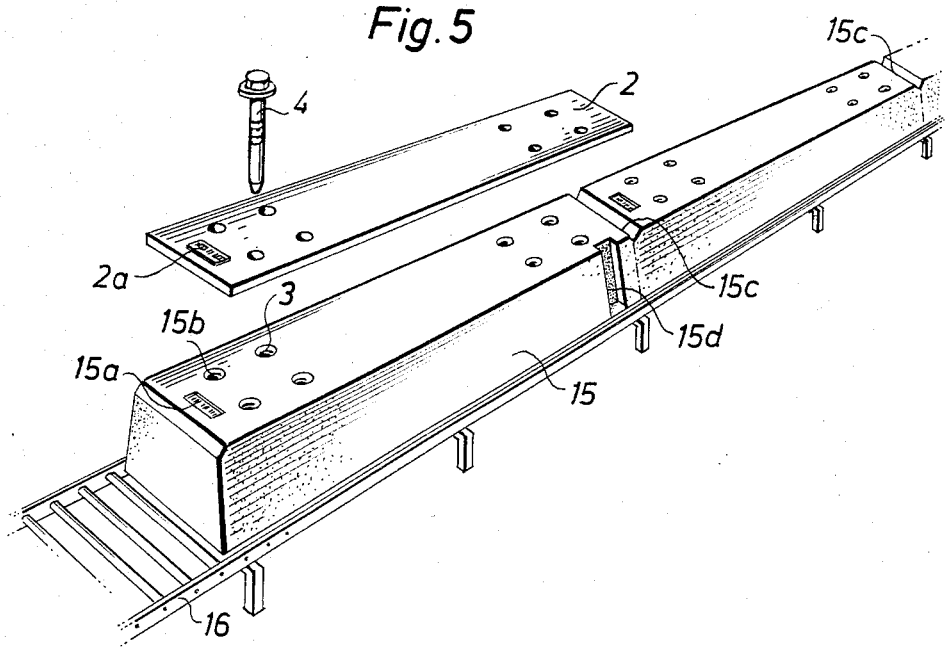
FIG. 5 is a perspective view of a concrete body according to FIG. 4 subsequent to arriving at said receiving station and being turned therein, and illustrating said body during the removal of a matrix.

FIG. 4 illustrates a hardened, coherent concrete body 15 subsequent to removing said body from the mould, said body being shown during its transport to a receiving table 16 shown in FIG. 5, by means of a crane hook 14 engaging the lifting eye 7.

FIG. 5 further illustrates that the concrete body 15 has been turned on the table 16 and that the matrices 2 can be removed subsequent to removing the bolts 4. The screw-threaded plastics dowels 3 are thus cast exactly in the desired locations in the concrete body. The dowels 3 form upon removal of the bolts 4 tapped through-passing holes 15*b* in the concrete body 15.

FIG. 5 also shows that the matrices 2 are provided with marking plates 2*a* on both sides, the lower marking plate—which is not visible in FIG. 5—leaving an imprint 15*a* in the concrete body 15 which enables respective sleeper blocks to be identified.

FIG. 5 also illustrates cutting indications 15*c* formed by the strips 9, and a cavity 15*d* formed by the dummy 8 shown in FIG. 1.

Figure 6:
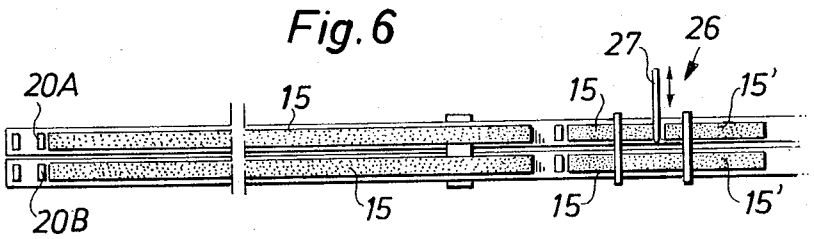
FIG. 6 is a plan view of two mutually adjacent parallel roller conveyors for the coordinate transport of cast concrete bodies to a diamond saw, for cutting said bodies into concrete sleepers of required length.

FIG. 6 illustrates two parallel, adjacent roller paths 20A and 20B arranged in connection with a cutting station 26, in which a diamond saw 27 is movable transversely of the concrete bodies, said saw being arranged to cut finished sleeper blocks 15' (FIG. 7) from said bodies 15. FIG. 6 illustrates the final cutting step for two concrete bodies 15, while two further similar concrete bodies await their turn to be cut.

Figure 7:
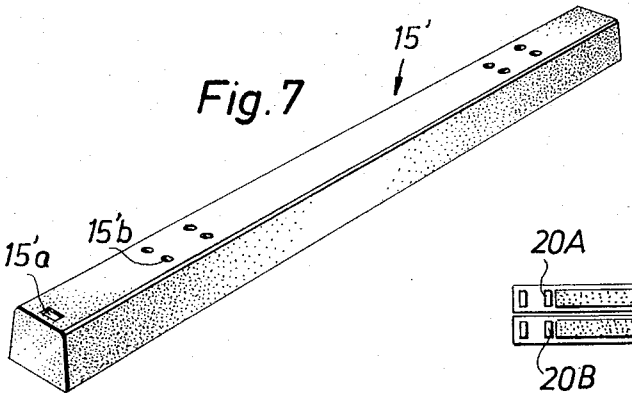
FIG. 7 illustrates a concrete sleeper manufactured by means of the method illustrated in the above mentioned figures.

FIG. 7 illustrates a finished sleeper block 15' ready to be delivered together with other sleeper blocks belonging to the manufactured railway switch-point, said blocks being of a nature such as to require no further manufacturing operations. At one end the sleeper block 15' has an identification imprint 15'*a*. Further, it comprises eight tapped holes 15'*b* adapted to receive corresponding bolts (not shown) for mounting rails (not shown) on the sleeper block.

Figure 9:
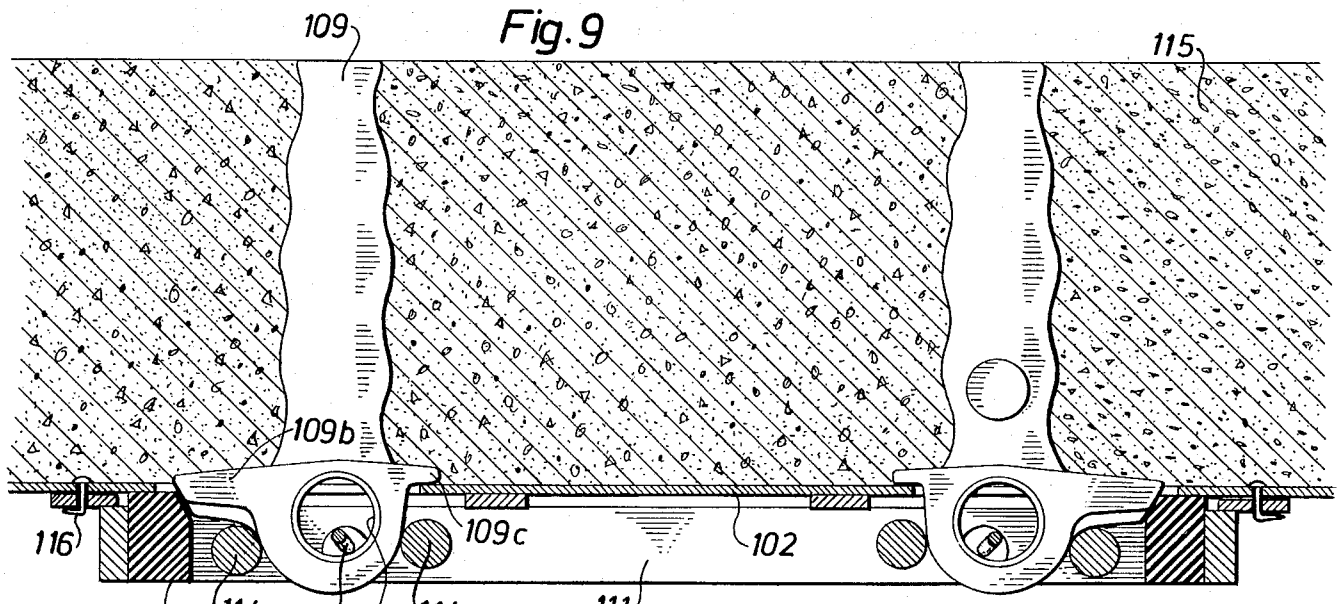
FIG. 9 is a cross-sectional view illustrating a part of a sleeper block having two attachment means according to FIG. 8 cast thereinto in accurate position by the aid of a frame member of the kind illustrated in FIG. 8.
Figure 10:
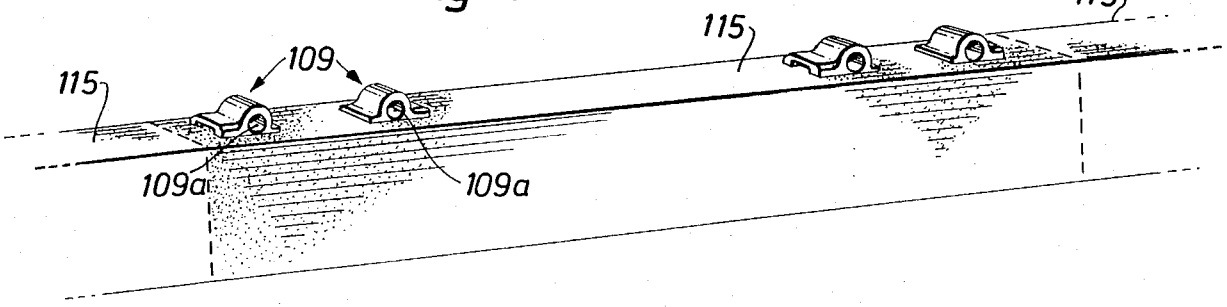
FIG. 10 is a perspective view of a part of a concrete body comprising several unseparated sleeper blocks one of which having four attachment means and being cast by the method according to the present invention.

The improvement according to the present invention shall now be described with reference to FIGS. 8–10.

Figure 8:
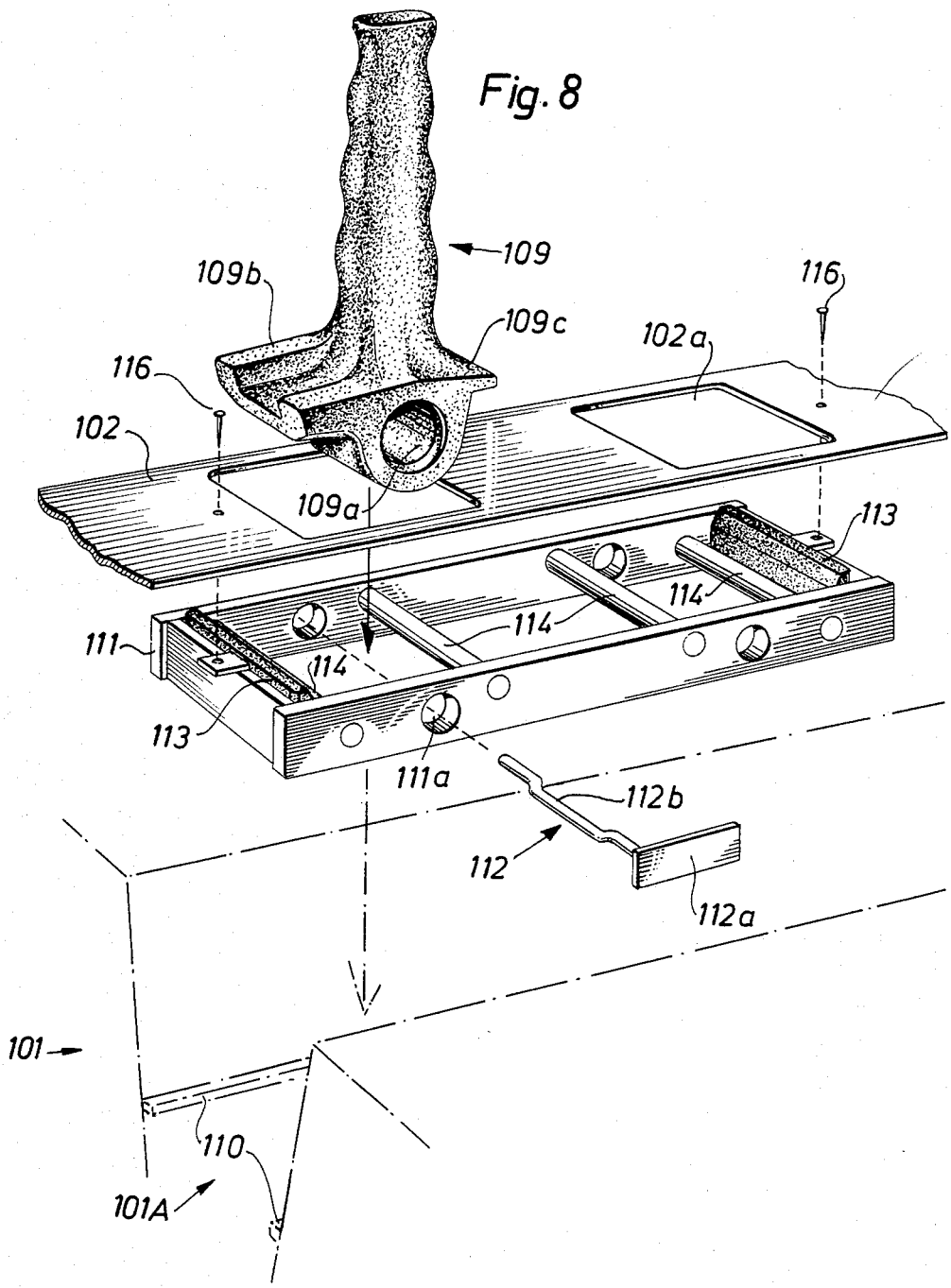
FIG. 8 is an exploded perspective view illustrating a frame member for accurate detachably securing another type of attachment means to a matrix according to the present invention.

In FIG. 8 there is shown a mould cavity 101A adapted to accommodate a plurality of mutually adjacent thin steel matrix plates 102 arranged to rest on opposite support ribs 110 extending lengthwise in the mould cavity 101A.

The steel matrix plates 102 have rectangular holes 102*a*. Upwardly extending attachment means in the form of dowels 109 have in one end a portion provided with a bore or hole 109*a* for anchoring a rail. The dowels 109 are accurately positioned one in each rectangular hole 102*a* in the way described below:

Thus, each dowel 109 is detachably secured in very accurate position relative to the appertaining matrix plate 102 by the aid of a frame member 111 the general shape of which is shown in FIG. 8. It is of rectangular shape. Two opposite holes 111*a* are used for securing each dowel 109 by means of a securing member 112 having one handle portion 112*a* and one stem portion 112*b* with the shape of a crank-shaft.

The stem portion 112*b* is passed through the opposite holes 111*a* in the frame member 111 and the bore or hole 109*a* in the dowel 109.

When handle 112*a* is turned the dowel's flange portion 109*b* will engage a crosswise extending rubber rib 113 in the frame member 111 whereas its opposite flange 109*c* will engage the matrix plate 102. Two crosswise extending rods 114 will then contribute to carefully locate the dowel 109 in the frame member 111.

The frame member 111 is, further, loosely attached to the matrix plate 102 by means of two bent nails 116, one in each end thereof.

When concrete is cast and hardens the nails 116 will permit movements between the cast concrete body and the frame member 111. The latter can also easily be removed upon pinching the nails 116.

The aim of the frame member 111 is accordingly to carefully locate the dowels 109 relative to the matrix plate 102 which can be made of thinner steel than the known matrix plate 2 described above.

After release each frame member 111 can be used again in a subsequent moulding operation.

The invention accordingly accomplishes better economy due to the possibility to use thin steel for the matrix plates. The holes 102*a* in the matrix plate 102 exhibit a play against each dowel 109, in the first place to permit movements of concrete relative to the plates 102 at curing and release of prestress. If the movements are sufficiently big the nails 116 will then be automatically pinched. The position of the holes for the nails 116 are determined and punched with great exactness and these holes are then used as guides when punching out the holes 102*a*. In this way very accurate location of the dowels 109 in the sleeper blocks is obtained.

The other advantages obtained by the known method described with reference to FIGS. 1–7 are also available.

I claim:

1. A matrix array for manufacturing concrete sleeper blocks (115) for a railway switching-point comprising a plurality of separate matrices having the form of substantially planar discs or plates (102) of substantially the same width as the upper surface of the sleeper blocks and having varying lengths corresponding to the desired lengths of individual sleeper blocks, and being provided with holes (102*a*) arranged at predetermined varying locations for detachably mounting attachment means (109) intended to be cast in the sleeper blocks, characterized in that the attachment means are detachably mounted in accurately predetermined positions in frame members (111) affixed to the discs, said attachment means having parts provided with bores or holes (109*a*) outside of the cast sleeper blocks, and, before the casting operation, being detachably mounted to the frame members by elongated securing members (112) having a longitudinal crank-shaft profile, said securing members extending through the bores or holes in said parts and through opposite holes (111*a*) in said frame members to secure the attachment means, and said frame members upon casting and hardening of the sleeper blocks being detachable from the discs and the in-cast attachment means for renewed use.

2. A matrix array according to claim 1, characterized in that said frame members have crosswise extending ribs (113) of elastic material such as rubber engaged by said attachment means when mounted to the frame by said securing members.

3. A matrix array according to claim 1, characterized in that said frame members are affixed to said discs by simple securing means such as bent nails (116) or pins permitting relative movements between the hardening concrete in the sleeper blocks and the frame members and easily pinchable for subsequent release of the frame members.

* * * * *